US012501955B2

(12) United States Patent
Wenkman et al.

(10) Patent No.: US 12,501,955 B2
(45) Date of Patent: Dec. 23, 2025

(54) MOTORCYCLE SHIRT OR SPEED-BOAT SHIRT WITH HOLD-DOWN ATTACHMENT DEVICE AND KIT THEREFOR

(71) Applicant: American Brands LLC, Phoenix, AZ (US)

(72) Inventors: William S. Wenkman, Phoenix, AZ (US); Gregory John Wenkman, Travelers Rest, SC (US)

(73) Assignee: American Brands LLC, Phoenix, AZ (US)

( * ) Notice: Subject to any disclaimer, the term of this patent is extended or adjusted under 35 U.S.C. 154(b) by 0 days.

(21) Appl. No.: 18/601,041

(22) Filed: Mar. 11, 2024

(65) Prior Publication Data

US 2024/0206578 A1 Jun. 27, 2024

Related U.S. Application Data

(63) Continuation of application No. 17/715,701, filed on Apr. 7, 2022, now Pat. No. 11,992,074, which is a continuation-in-part of application No. 16/943,854, filed on Jul. 30, 2020, now Pat. No. 11,497,265.

(51) Int. Cl.
*A41F 17/02* (2006.01)

(52) U.S. Cl.
CPC ..... *A41F 17/02* (2013.01)

(58) Field of Classification Search
CPC ..... A41F 17/00; A41F 9/007
See application file for complete search history.

(56) References Cited

U.S. PATENT DOCUMENTS

| | | | | | |
|---|---|---|---|---|---|
| 146,175 | A | | 1/1874 | Flynt | |
| 148,193 | A | | 3/1874 | Dunbar | |
| 388,075 | A | | 8/1888 | Saegar | |
| 388,123 | A | * | 8/1888 | Cohen | A41D 1/02 2/93 |
| 399,238 | A | * | 3/1889 | Brodnax | A41F 5/00 24/165 |
| 443,376 | A | * | 12/1890 | Peiter | A41F 5/00 2/117 |
| 730,137 | A | | 6/1903 | Livingston | |
| 845,999 | A | * | 3/1907 | Bernstein | A41F 5/00 2/117 |
| 866,183 | A | * | 9/1907 | Bernstein | A41F 5/00 2/117 |
| 925,121 | A | | 6/1909 | Melze | |
| 932,540 | A | | 8/1909 | Pfiffner | |
| 948,199 | A | | 2/1910 | Anderson | |
| 959,441 | A | | 5/1910 | Anderson | |
| 1,172,615 | A | * | 2/1916 | Leansky | A41D 15/00 2/70 |
| 1,183,511 | A | * | 5/1916 | Adams | A41D 13/02 2/70 |
| 1,199,689 | A | | 9/1916 | Gewandter | |
| 1,280,184 | A | * | 10/1918 | Dow | A41F 15/002 2/323 |
| 1,308,561 | A | * | 7/1919 | Teeters | B63C 9/1055 441/104 |

(Continued)

*Primary Examiner* — Khaled Annis
(74) *Attorney, Agent, or Firm* — Joseph T. Leone; Yanjun Ma; DeWitt LLP

(57) ABSTRACT

A hold-down attachment device attachable to the inside of a shirt and configured to reversibly attach to a wearer's pants or belt to retain the shirt in the proper position on a wearer's body.

16 Claims, 13 Drawing Sheets

(56) References Cited

U.S. PATENT DOCUMENTS 1,392,935 A * 10/1921 Glickman ..... A41F 5/00 24/301
1,760,247 A * 5/1930 Mckenzie ..... A41C 1/06 450/86
1,861,959 A * 6/1932 Greenberg ..... A41F 5/00 2/229
1,883,341 A 10/1932 Dauphinais
1,939,327 A * 12/1933 Vanace ..... A41F 5/00 2/117
1,986,519 A * 1/1935 Murray ..... A41F 17/00 24/698.2
1,998,085 A 4/1935 Kahn
2,028,602 A * 1/1936 Hanson ..... A41B 13/08 2/70
2,154,684 A * 4/1939 Kool ..... A41F 5/00 2/117
2,671,222 A 3/1954 Hochberg
2,895,480 A * 7/1959 Fixel ..... A41F 17/00 450/111
3,418,659 A * 12/1968 Brown ..... A41F 5/00 2/70
4,074,364 A * 2/1978 Lucero ..... A41F 17/00 2/117
4,481,682 A 11/1984 Hall
4,596,569 A 6/1986 Campbell
4,597,109 A 7/1986 Hironaga
4,853,979 A 8/1989 Ryder
4,937,886 A 7/1990 Ellis
4,947,489 A * 8/1990 Greenwood ..... A41F 5/00 2/919
5,033,121 A 7/1991 Larsen
5,117,813 A 6/1992 Bosack
5,177,813 A * 1/1993 Bosack ..... A41F 17/00 2/325
5,177,814 A * 1/1993 Courtney ..... A41F 17/00 2/326
5,276,923 A * 1/1994 Cohen ..... A41F 17/00 2/229
5,309,572 A * 5/1994 Seamans ..... A41F 5/00 2/112
5,313,669 A * 5/1994 Rasdell ..... A41F 17/00 2/112
5,488,738 A * 2/1996 Seamans ..... A41F 5/00 2/112
5,515,544 A 5/1996 Hosking
5,682,619 A 11/1997 Griffin
5,774,899 A 7/1998 Griffin
6,026,516 A 2/2000 Dacyshyn
6,163,890 A * 12/2000 Utamaru ..... A41F 3/02 2/326
6,167,573 B1 1/2001 Lewis
D487,468 S 3/2004 Genao
6,698,031 B2 * 3/2004 Lewis ..... A41F 3/00 2/340
6,959,455 B2 11/2005 Hall
7,047,567 B2 * 5/2006 Allen ..... A41D 13/0007 2/69
7,398,558 B1 * 7/2008 Kattenhorn ..... A41F 5/00 2/79
7,412,730 B2 * 8/2008 Schroeder ..... A41F 5/00 2/340
7,438,619 B2 * 10/2008 Staver ..... A41D 7/001 441/115
8,011,019 B1 * 9/2011 Hamid ..... A41D 13/018 2/69
8,209,779 B2 7/2012 Herman
8,291,515 B2 10/2012 Carter
8,601,615 B2 12/2013 Isaacson
8,769,780 B1 7/2014 Segel
8,832,866 B2 9/2014 Herman
8,918,915 B2 * 12/2014 Caulfield ..... A41D 7/005 2/67
9,049,895 B1 6/2015 Wesol
9,339,071 B2 5/2016 Herman
9,433,250 B2 9/2016 Merchen
9,913,505 B1 3/2018 Wilson
9,924,752 B2 * 3/2018 Horrey ..... A41F 17/00
9,999,268 B2 6/2018 Pagcaliwagan
10,051,904 B2 8/2018 Isaacson
10,076,202 B1 * 9/2018 Nickoles ..... A47G 25/90
10,113,265 B2 * 10/2018 Durney ..... F16B 2/10
10,165,815 B1 * 1/2019 Branker ..... A41F 1/008
10,219,565 B2 * 3/2019 Banta ..... A41F 5/00
10,595,576 B1 * 3/2020 Hopkins ..... A41F 17/00
10,667,570 B2 6/2020 Oliva
10,827,791 B2 * 11/2020 Banta ..... A41F 5/00
11,350,676 B1 * 6/2022 Law ..... A41F 17/00
11,497,265 B2 * 11/2022 Wenkman ..... A41F 9/007
2001/0000361 A1 * 4/2001 Alger ..... A41F 5/00 24/304
2002/0112275 A1 8/2002 Hall
2003/0172431 A1 * 9/2003 Allen ..... A41D 13/0007 2/69
2006/0010559 A1 1/2006 Hamlet
2006/0048266 A1 3/2006 Kim
2006/0185056 A1 8/2006 Zwick
2007/0192998 A1 * 8/2007 Ryder ..... A41F 17/02 24/1
2007/0256216 A1 * 11/2007 Kronen ..... A41F 3/02 2/304
2009/0070915 A1 * 3/2009 Hill ..... A41B 1/00 2/311
2009/0210996 A1 8/2009 Hu
2010/0192285 A1 * 8/2010 Ahn ..... A41B 11/14 2/243.1
2010/0235969 A1 9/2010 Isaacson
2011/0197335 A1 * 8/2011 Handy ..... A41F 5/00 2/117
2012/0090078 A1 * 4/2012 von Olnhausen ..... A41C 3/08 2/326
2012/0246805 A1 10/2012 Jones
2013/0247280 A1 9/2013 Haggard
2013/0291277 A1 * 11/2013 Kirkwood ..... A41F 17/00 2/69
2014/0101814 A1 * 4/2014 Caulfield ..... A41D 7/00 2/74
2014/0101815 A1 * 4/2014 Caulfield ..... A41F 17/00 2/400
2014/0215690 A1 * 8/2014 Caulfield ..... A41F 17/00 2/227
2014/0304899 A1 10/2014 Almonte
2015/0040285 A1 * 2/2015 Mobayyen ..... A41B 9/08 2/70
2015/0101109 A1 * 4/2015 Herman ..... A41F 17/00 2/326
2015/0135399 A1 5/2015 O'Donnell
2015/0230531 A1 8/2015 Merchen
2015/0237939 A1 * 8/2015 Banta ..... A41F 5/00 450/28
2016/0007666 A1 1/2016 Pagcaliwagan
2016/0081461 A1 * 3/2016 Marx ..... A45F 3/14 224/259
2016/0324238 A1 * 11/2016 Tran ..... A41B 1/06
2016/0338415 A1 11/2016 Aihara
2016/0360811 A1 * 12/2016 Banta ..... A41F 5/00
2017/0202288 A1 7/2017 O'Donnell
2017/0231287 A1 8/2017 O'Donnell
2017/0238637 A1 8/2017 O'Donnell
2018/0132537 A1 * 5/2018 Siegfried ..... A41F 9/00
2018/0213851 A1 8/2018 O'Donnell
2019/0014844 A1 * 1/2019 Osman ..... A41F 17/00
2019/0053558 A1 * 2/2019 Spencer ..... A41F 17/00
2019/0082761 A1 * 3/2019 Koen ..... A41D 15/00
2019/0223529 A1 * 7/2019 Park ..... A41B 1/08
2019/0246726 A1 * 8/2019 Oliva ..... A41F 17/00
2020/0323298 A1 * 10/2020 Morgan ..... A41F 3/02
2022/0030996 A1 * 2/2022 Wenkman ..... A41F 9/007
2022/0061439 A1 * 3/2022 Rhode ..... A41F 17/00
2022/0225711 A1 * 7/2022 Wenkman ..... A41F 17/00

* cited by examiner

MOTORCYCLE SHIRT OR SPEED-BOAT SHIRT WITH HOLD-DOWN ATTACHMENT DEVICE AND KIT THEREFOR

CROSS-REFERENCE TO RELATED APPLICATIONS

This is a continuation of co-pending application Ser. No. 17/715,701, filed Apr. 7, 2022, which is a continuation-in-part of application Ser. No. 16/943,854, filed Jul. 30, 2020 (now U.S. Pat. No. 11,497,265, issued Nov. 15, 2022), both of which are incorporated herein by reference.

FIELD OF INVENTION

Disclosed herein is a shirt designed for wear during high-speed activities, such as motorcycling and speedboating. The shirt comprises a hold-down attachment device dimensioned and configured to inhibit creeping and ballooning of the shirt caused by high-speed winds. Also disclosed herein is a kit to modify or retrofit an existing shirt to comprise the hold-down attachment device. The hold-down attachment device functions to inhibit creeping and ballooning of the shirt, even when the shirt is not tucked into the wearer's pants.

BACKGROUND OF THE INVENTION

The patent literature discloses several shirt hold-down devices for restraining the movement of a shirt on the wearer's upper body. See, for example, U.S. Pat. No. 4,074,364, issued Feb. 21, 1978, to Lucero, U.S. Pat. No. 5,177,814, issued Jan. 12, 1993, to Courtney, U.S. Pat. No. 5,276,923, issued Jan. 11, 1994, to Cohen, U.S. Pat. No. 9,433,250, issued Sep. 6, 2016, to Merchen, and U.S. Pat. No. 9,924,752, issued Mar. 27, 2018, to Horrey. These patents share a common theme in that they are dimensioned and configured to prevent unwanted movement of a shirt that is tucked into the wearer's pants or other lower body garment, or undergarment.

The prior art does not reveal a shirt hold-down device intended to prevent unwanted movement of the shirt when the shirt's tails are not tucked into the wearer's pants.

Likewise, the prior art does not reveal any shirt hold-down device dimensioned and configured to prevent unwanted movement of a shirt on the wearer's upper body when the wearer is involved in high-speed activities, such as when riding a motorcycle, piloting a speedboat, and the like.

SUMMARY

There exists an annoying and distracting problem that motorcycle riders and others who participate in high-speed activities experience. Their shirt, while worn outside the pants, has a tendency to lift up and away from the wearer's upper body while in motion. Of course, a shirt can be held in place by tucking it into the pants and using a belt to cinch it in place. However, fashion trends and styles change. Many modern riders, men especially, like shirt styles that are purposefully designed to be worn untucked. Due to the aerodynamic forces at work on the motorcycle rider while in motion, an untucked shirt lifts up and away from the rider's body. This is both annoying and a potentially dangerous distraction.

The phenomenon is made worse by the recent fashion trend away from heavyweight cotton shirts to lightweight polyester shirts. Even when the weather is warm, many motorcycle riders have chosen to wear a heavy vest that holds down the rider's shirts and prevents the shirt from riding up on the wearer or flapping vigorously while in motion.

Additionally, in a strong headwind, an untucked shirt ride up high enough to obstruct a motorcycle driver's view. Even if the shirt does not ride up quite that high, the wearer's belly is displayed for all to see. Obviously, this is not an easy problem to fix at speed and a distracted driver is a dangerous driver.

Disclosed herein is a shirt manufactured with or modified to comprise a hold-down device dimensioned and configured to retain the shirt in the proper position when the shirt is worn untucked (i.e., outside the wearer's pants). The shirt and its hold-down device retains the shirt in the proper orientation on the on the wearer's upper body even while the wearer is engaging in high-speed activities such as motorcycle riding or riding in a speed-boat.

Also disclosed herein is a kit to retrofit the hold-down device disclosed herein onto a pre-existing shirt.

The main goal of the shirt and its associated hold-down device is to provide a fashionable shirt that can be worn untucked and yet still stay in place in high winds and when engaged in high-speed, outdoor activities, where without the hold-down device, the shirt would balloon and shift on the wearer's body.

There exists a need for shirt manufacturers and shirt modifiers to address the problem of lightweight shirts lifting away from the wearer's body while the wearer is riding a motorcycle or engaged in other high-speed activities (or in high winds period). There are numerous shirt modifiers who customize shirts for the motorcycle apparel industry. Such modifications include, for example, adding decorative appliqués or other embellishments, embroidered and/or woven patches, silk-screened designs, hot-stamped designs, and the like. Companies in the clothing modification business in particular have the opportunity, while embellishing the shirts in other ways, to add the shirt hold-down device disclosed herein. Shirt manufacturers that cater to the sports apparel industry will find the device useful to be added to their shirts as "original equipment" at the time of initial manufacturing. The consumer will find the shirt-hold-down kit extremely useful as it provides the consumer with the necessary components to modify their existing ordinary shirts into shirts with the hold-down device.

It is another object of the present invention to provide quick and easy attachment of the shirt hold-down device to the wearer's pants and/or pants belt by means of quick attach/detach mechanism. Whenever the word "pants" is used in this disclosure, the belt loops of the pants are considered to be part of the definition of the word "pants."

The shirt hold-down device can also, optionally, be dimensioned and configured to allow the wearer to determine the desired tension, or pressure, or force in holding down the shirt on the wearer's shoulders. This is accomplished using an adjuster, such as such as Tri-glide strap adjusters, elastic straps with or with buttonholes, or cord locks, or other strap and or cord adjusters or locks known in the art.

It is another object of the present invention to provide a means to allow the shirt manufacturer and shirt modifier to quickly and efficiently attach the elongated strap and or cord members directly to the shirt by means of ultrasonic welding, heat fusing, UV adhesive, heat-activated adhesive, or stitching to the shirt.

It is another object of the present invention to provide a means for the shirt modifier who is embellishing the shirt with heat-activated patches to add heat-activated patches with an integral attachment devices (refer to the inventor's patent application Ser. No. 17/315,280 filed on May 8, 2021) to allow the elongated strap and or cord members to be hung from or attached to the patches.

It is another object of the present invention to provide a means too quickly an easily allow the wearer to attach/detach the shirt hold-down device)s) between the shirt and the wearer's pants and or pants' belt by a numerous quick attachment/release devices known in prior art.

It is another object of the present invention to provide a shirt hold-down device that attaches to the lower front center of the shirt, at least three inches above the hem of the shirt, at either the outer or inner placket, or placket button, or placket buttonhole, or center of the lower shirt, whereby a shirt hold-down device is attached to the outer or inner placket, or a placket button, or a placket buttonhole, or other attachment device at the lower center area of the shirt for the purpose of attaching a shirt hold-down device to the wearer's pants, such as the pants' zipper fly or flap by means of an alligator clamp connected to the hold-down device for the purpose to hold-down the front of the shirt from exposing the belly of the rider while in motion on a motorcycle.

Thus, disclosed herein are:

1. A shirt comprising:
   - a shirt hold-down device permanently or releasably attached thereto, the shirt hold-down device comprising:
   - a tether having a first end and a second end; and
   - first and second fasteners attached to the tether at a distance apart, wherein the first fastener is attached proximate to the first end of the tether and the second fastener is attached proximate to the second end of the tether;
   - wherein the first fastener is dimensioned and configured to attach to an inside surface of the shirt permanently or releasably; and
   - wherein the second fastener is dimensioned and configured to attach to a wearer's pants or a wearer's belt releasably; and
   - wherein the first fastener or the second fastener or both the first and second fasteners are movably attached to the tether such that the distance between the first and second fasteners along the tether can be varied.

The shirt is a t-shirt, a pull-over partial button-down shirt, a collared shirt, a collarless shirt, a full button-up shirt, a full button-down shirt, a long or short sleeve shirt, or the like.

The tether comprises a cord having a substantially circular cross-section.

Alternatively, the tether comprises a ribbon having a substantially rectangular cross-section.

The first fastener comprises a heat-activated patch having a button attached thereto permanently affixed to the inside surface of the shirt and a corresponding loop or aperture defined in the first end of the tether and dimensioned and configured to releasably attach to the button.

The aperture defined in the first end of the tether is defined by a length of material having juxtaposed first and a second button holes defined therein, and coated on one side with a permanent adhesive, wherein the length of material is folded upon itself with the first end of the tether interposed therebetween such that the first and second button holes are in registration and the permanent adhesive contacts the first end of the tether such that the length of material is permanently adhered to the tether.

The second fastener is an alligator clip.

Alternatively, the second fastener is a hook dimensioned and configured to releasably attach to a belt and having two apertures passing therethrough, wherein the tether passes through the two apertures, and further comprising a stop slidably attached proximate to the second end of the tether and dimensioned and configured to prevent the tether from being withdrawn from the two apertures in the hook.

Alternatively, the second fastener is spring-biased cord lock slidably disposed around the tether and having defined therein a hook dimensioned and configured to releasable attach to a belt or belt loop of a wearer.

2. A shirt comprising:
   - a shirt hold-down device permanently attached thereto, the shirt hold-down device comprising:
   - a tether having a first end and a second end; and
   - first and second fasteners attached to the tether at a distance apart, wherein the first fastener is attached proximate to the first end of the tether and the second fastener is attached proximate to the second end of the tether;
   - wherein the first fastener is permanently attached to an inside surface of the shirt; and
   - wherein the second fastener is dimensioned and configured to attach to a wearer's pants or a wearer's belt releasably; and
   - wherein the second fastener is movably attached to the tether such that the distance between the first and second fasteners along the tether can be varied.

The second fastener is an alligator clip.

Alternatively, the second fastener is a hook dimensioned and configured to releasably attach to a belt and having two apertures passing therethrough, wherein the tether passes through the two apertures, and further comprising a stop slidably attached proximate to the second end of the tether and dimensioned and configured to prevent the tether from being withdrawn from the two apertures in the hook.

Alternatively, the second fastener is spring-biased cord lock slidably disposed around the tether and having defined therein a hook configured to releasable attach to a belt or belt loop of a wearer.

3. A shirt hold-down device, the shirt hold-down device comprising:
   - a tether having a first end and a second end; and
   - first and second fasteners attached to the tether at a distance apart, wherein the first fastener is attached proximate to the first end of the tether and the second fastener is attached proximate to the second end of the tether;
   - wherein the first fastener is dimensioned and configured to attach to an inside surface of the shirt permanently or releasably;
   - wherein the second fastener is dimensioned and configured to attach to a wearer's pants or a wearer's belt releasably;
   - wherein the first fastener or the second fastener or both the first and second fasteners are movably attached to the tether such that the distance between the first and second fasteners along the tether can be varied.

The second fastener is an alligator clip.

Alternatively, the second fastener is a hook dimensioned and configured to releasably attach to a belt and having two apertures passing therethrough, wherein the tether passes through the two apertures, and further comprising a stop slidably attached proximate to the second end of the tether and dimensioned and configured to prevent the tether from being withdrawn from the two apertures in the hook.

Alternatively, the second fastener is spring-biased cord lock slidably disposed around the tether and having defined therein a hook configured to releasable attach to a belt or belt loop of a wearer.

The first fastener comprises a heat-activated patch having a button adhered to it and the tether defines a corresponding aperture proximate the first end, the aperture dimensioned and configured to releasably attach to the button.

The shirt hold-down device further comprises, in combination, a heat-resistant, removable spacer interposed between the heat-activated patch and the button.

Also disclosed herein is shirt hold-down device comprising an anchor dimensioned and configured to attach to an inside surface of a shirt. The device includes a first fastener attached to the anchor and a flexible connector having a first end and a second end. The first end of the flexible connector is dimensioned and configured to releasably attach to the first fastener. The device further includes a second fastener comprising a first structure dimensioned and configured to releasably attach to the second end of the flexible connector and a second structure dimensioned and configured to releasably attach to an article of clothing such as the pants, belt, and/or belt loops of the wearer.

In one version of the device, the anchor comprises permanent adhesive. The adhesive may be a heat-activated permanent adhesive.

The flexible connector may, for example, have a substantially circular transverse cross-section or a rectangular transverse cross-section.

In one specific version of the device, the first fastener is a button and the flexible connector defines at least one corresponding buttonhole passing therethrough. Alternatively, the first fastener is a button and the flexile connector defines a loop adjacent its first end, wherein the loop is dimensioned and configured to releasably engage with the button.

In another version of the device, the second fastener defines an aperture through which the flexible connector passes. The second fastener may also comprise a spring clip. The second fastener may also comprise a hook dimensioned and configured to connect releasably to a wearer's pants belt.

DETAILED DESCRIPTION

Figure 1:
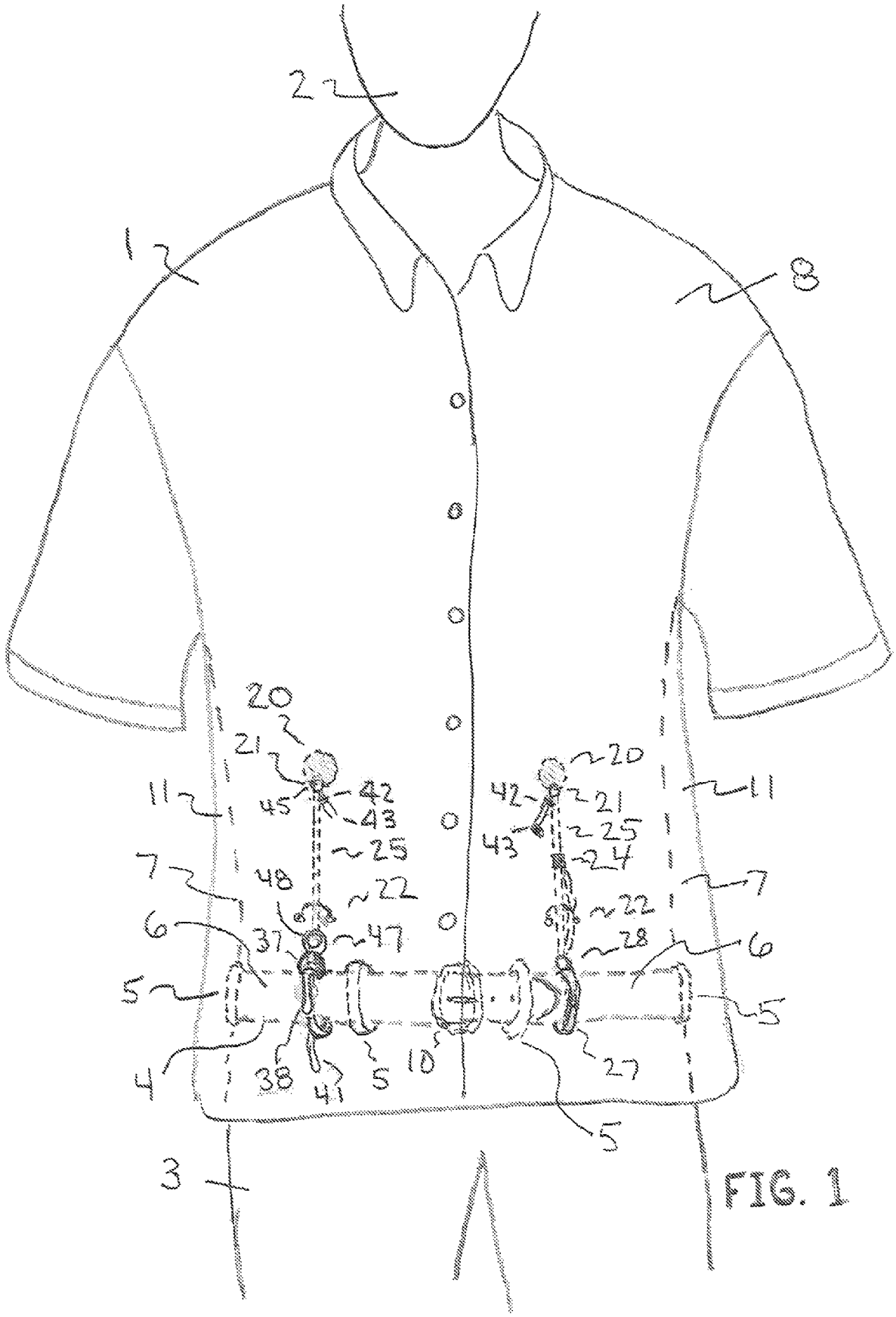
FIG. 1 is a front elevation showing a wearer wearing a first version of a shirt with hold-down devices as disclosed herein. The shirt includes hold-down devices between the inside of the shirt and the wearer's pants.

The preferred versions of the shirt hold-down device are illustrated in the drawings, which are exemplary rather than limiting. To the extent possible, the same reference numerals are used throughout the drawings to designate the same or analogous structures. As the heart of the device is a tie-down that is either permanently or removably fixed to the inside surface of a shirt, at a point generally midway to closer to the tails of the shirt and which is dimensioned and configured to releasably attach the shirt to the wearer's pants, either via a direct connection to pants or belt loops of the pants (e.g., by way of a fastener such as a button, hook-and-loop, spring clip, and the like) or to the wearers belt via a fastener dimensioned and configured to releasably fasten to a belt. The tie-down device can be integrated into a finished shirt, pre-retail sale (i.e., as an original equipment item) or can be sold separately as a kit that an end-user affixes to a shirt already owned.

Referring now to the figures, FIG. 1 is a front elevation showing a wearer 2 wearing a first version of a shirt 1 with hold-down devices as disclosed herein. The shirt includes hold-down devices between the inside of the shirt and the wearer's pants 3. FIG. 1 shows the front 8 of a shirt 1 and the pants 3, belt loops 5, belt 6, and belt buckle 10 of the wearer 2. The belt 6 includes a lower edge 4. The torso 7 of the wearer 2 is shown in broken lines. Also illustrated are the lateral sides 11 of the shirt. Shown in FIG. 1 is a shirt hold-down device comprising, from top to bottom, an iron-on heat activated adhesive patch 20 with a sewn-on button hanger 21 that is adhered to inside of shirt 1. The left portion of the drawing shows a first version of the shirt hold-down device. A cord 25 is looped around the button hanger 21 (at point 45) and extends through a cord crimp lock 42 dimensioned and configured to releasably grasp the cord 25. The end of the cord is shown at 43. The elongated cord 25 may optionally be retained in (optional) retainer loop 22. The cord 25 enters the top of cord lock 47 which has cord lock adjuster button 48 which allows the wearer 2 to adjust the length of the cord 25 between the button hanger 21 and the cord lock 47. The cord lock 47 may be attached to an optional split ring 37 that is attached to a belt hook 38 that is reversibly attached to the wearer's pants belt 6.

On the right portion shows a second version of the device. Here, the device is the same with respect to cord 25 looped around the button hanger 21 (at point 45) and extends through a cord crimp lock 42 dimensioned and configured to releasably grasp the cord 25. Rather than having a belt hook 38 and cord lock 47, the version on the right side of FIG. 1 has a retainer 27 that is dimensioned and configured to permit the wearer's belt 6 to pass therethrough and also includes an aperture 28 passing therethrough. The aperture 28 is dimensioned and configured to permit the cord 25 to pass therethrough. A keeper 24 is disposed around the cord 25 and is dimensioned and configured to allow the far end of the cord 25 to pass therethrough and to hold it in place. In this fashion, the cord 25 extends from the button hanger 21, passes through the aperture 28 in retainer 27 and then passes through and is held in place by the keeper 24. By adjusting the length of the cord 25 that passes through the keeper 24, the distance between the button hanger 21 and the user's belt 6 can be adjusted.

Figure 2:
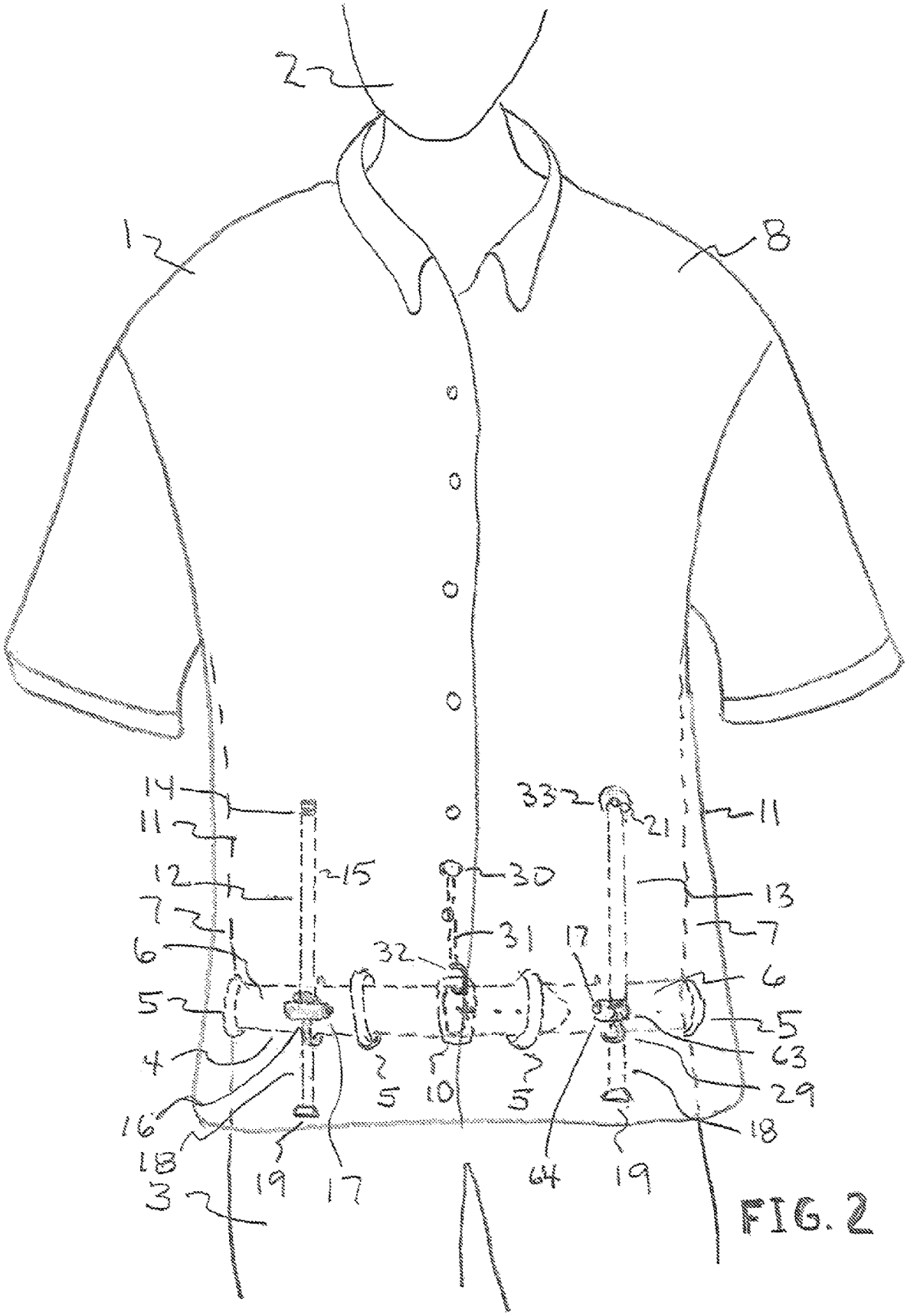
FIG. 2 is a front elevation showing a wearer wearing a second version of a shirt with hold-down devices as disclosed herein.

FIG. 2 is a front elevation showing a wearer wearing a second version of a shirt with hold-down devices as disclosed herein. FIG. 2 illustrates one embodiment of the present invention, showing the front 8 of a shirt 1 on the wearer 2. The wearer also is wearing pants 3 having belt-loops 5 and a belt 6. The lower side/edge of the belt 6 is shown at 4. The torso of the wearer 2 is shown in broken line at 7 and the lateral edge of the shirt at 11. In this version of the hold-down device, an elongated strap 12 which has a back side 15 connected to shirt 1. This can be accomplished by any suitable means (which are not critical), such as by ultrasonically welding, UV adhesive gluing, or stitching the upper end 14 of strap 12 to the inside, front surface of shirt 1. At the distal end 18 from upper end 14 is a pull 19. Between the upper end 14 and the pull 19, the strap 12 passes through an adjustable belt clip 16 or 29. The belt clip 16 includes a releasable clamp 64 dimensioned and configured to grip the strap 12 firmly—thereby inhibiting movement of the shirt 1 on the torso 7 of the wearer 2. When the clamp 64 is released (by the user pressing release button 17), the cord 12 slides freely through the belt clip 16. This allows the distance between the upper end 14 and the belt clip 16 to be adjustable when release button 17 is actuated. That distance is then fixed when the release button 17 is released to close and grip the strap 12 firmly. In this fashion, the wearer can adjust amount of tension or hold-down force the shirt experiences when riding a motorcycle or engaging in other high-speed activities.

Figure 3:
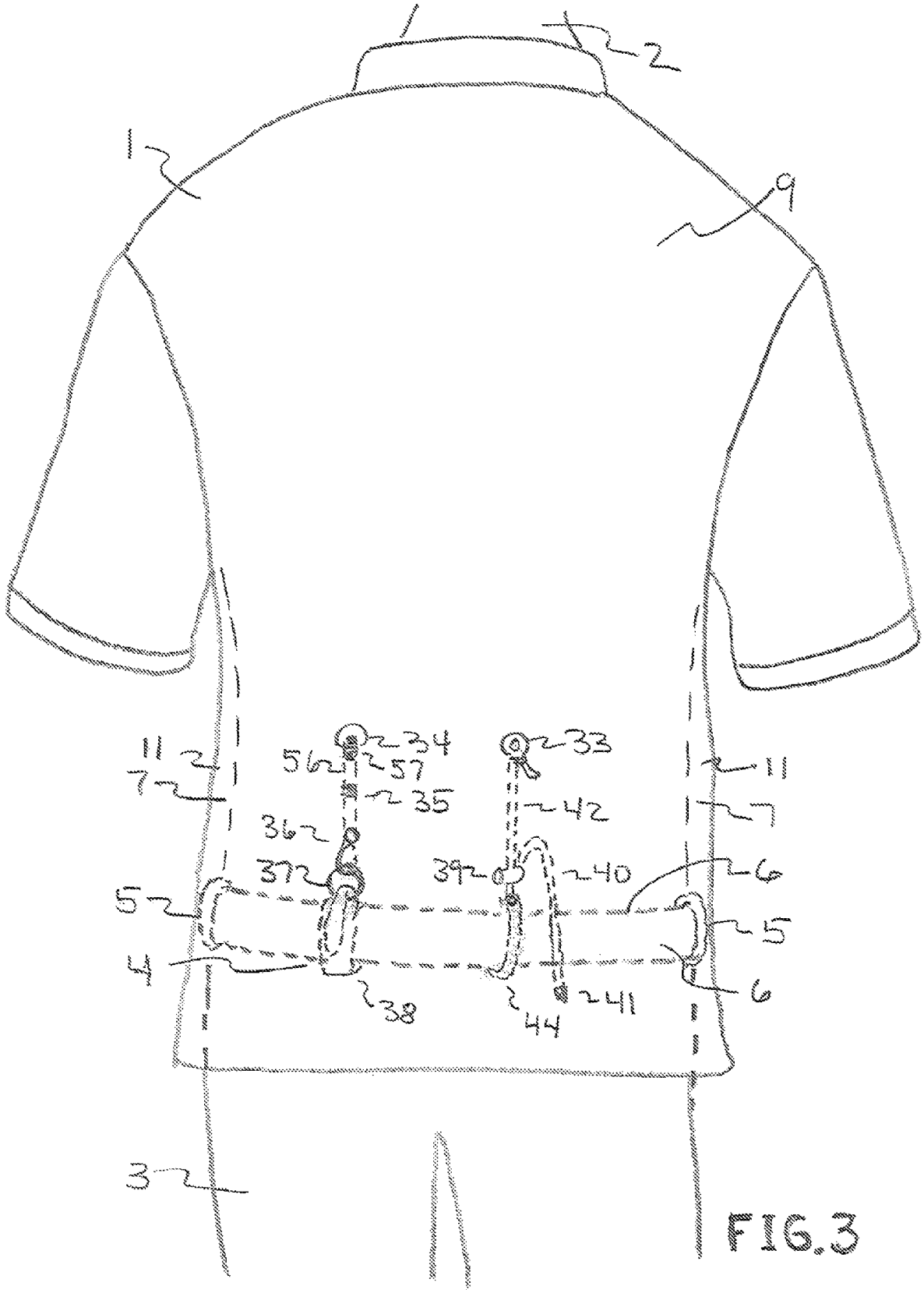
FIG. 3 is a rear elevation showing a wearer wearing third version of a shirt with hold-down devices as disclosed herein.

FIG. 3 is a rear elevation showing a wearer wearing third version of a shirt with hold-down devices as disclosed herein. As discussed above, the wearer 2 is dressed with shirt 1, shown from the back panel 9 of the shirt. Adhesive patches with a hangers 33 and 34 are provided. A cord 42 or strap 35 is connected to the inside of the shirt via the adhesive patches 33 and 34. The cord 42 or strap 35 is dimensioned and configured to connect the hangers 33 and 34 with the wearer's belt loops 5 or belt 6. As shown on the left-hand side of the figure, this can be accomplished via belt hook 38, split ring 37, and hook 36. Alternatively, as shown on the right in FIG. 3, the distal end 41 of cord 42 passes through spring clamp 39, which is of conventional design and connected to belt hook 44. By releasing spring clamp 39, the length 40 of cord 42 between the spring clamp 39 and distal end 41 can be adjusted in increase or decrease the amount of tension applied to the back of the shirt.

Figure 3A:
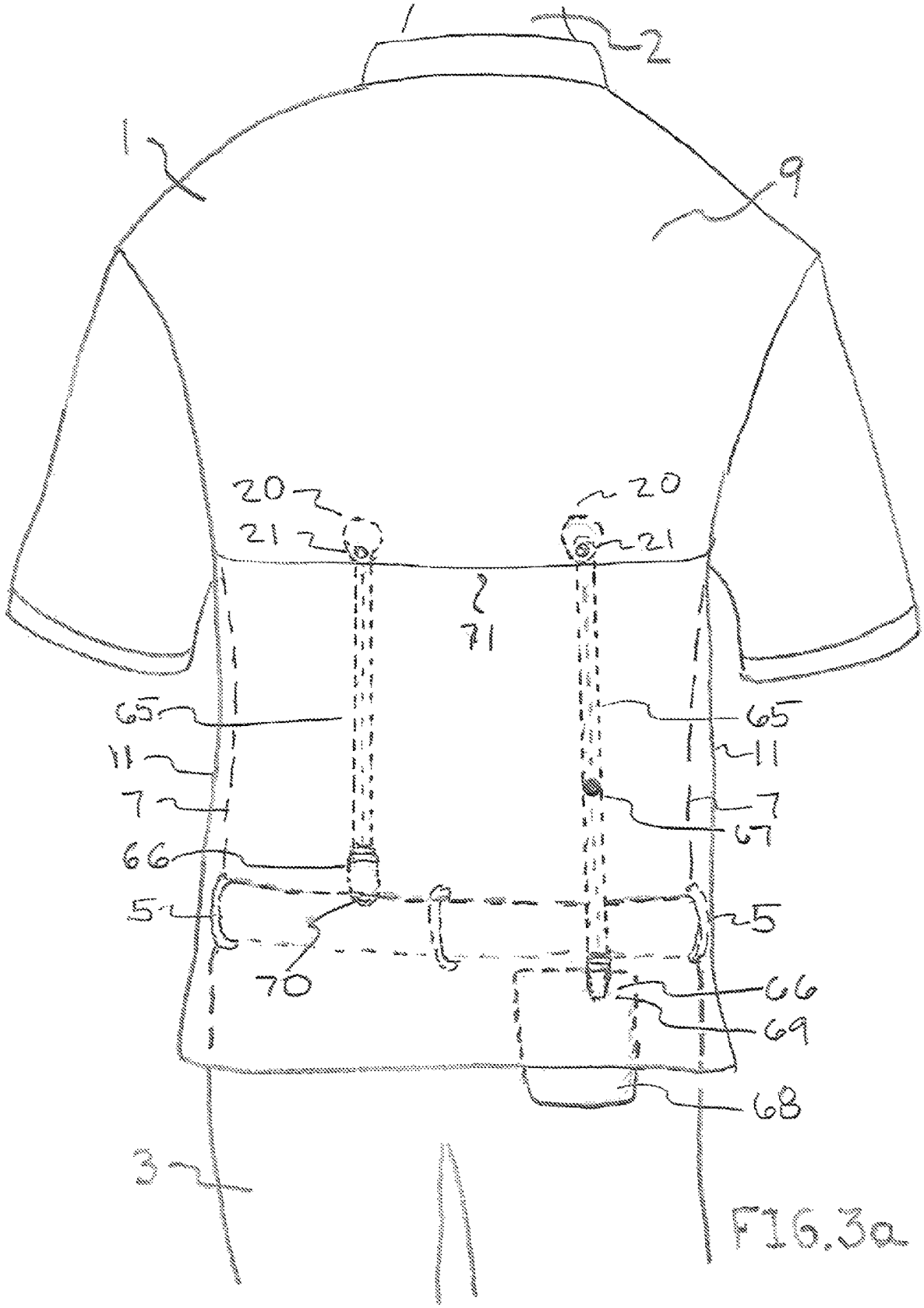
FIG. 3*a* is a rear elevation showing a wearer wearing a fourth version of a shirt with hold-down devices as disclosed herein.

FIG. 3*a* is a rear elevation showing a wearer wearing a fourth version of a shirt with hold-down devices as disclosed herein. Here, the device is similar to that described in FIG. 3, but adhesive patches/button hangers 20 and 21 (respectively) are connected to alligator clips 66. Again, a strap or cord 65 is provided that is configured to releasably connect at the top end to the button hanger 21 and at the distal, bottom end to the alligator clamp 66. Button holes 67 are provided to adjust the working distance between the button hanger 21 and the alligator clamp 66. As shown in the figure, the clamp 66 can be attached to the wearer's belt (as shown at 70), or to the top edge 69 of the rear pocket 68 of the user's pants 3.

Figure 4:
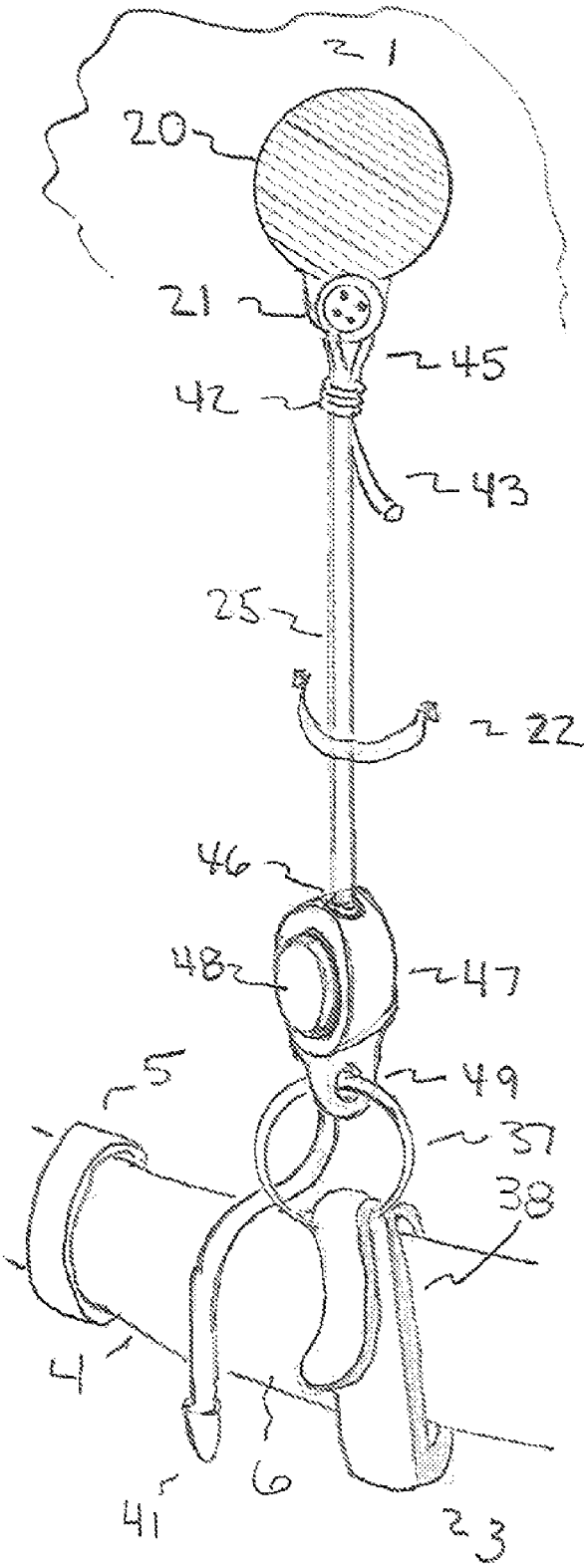
FIG. 4 is a magnified, cutaway view of the shirt with hold-down device attached to the inside of the shirt in its extended and connected position between the wearer's shirt and the wearer's pants belt.

FIG. 4 is a magnified, cutaway view of the shirt with another hold-down device as shown in the left-hand side of FIG. 1. Shown in cutaway is the shirt 1 and the pants 3, belt loops 5, and belt 6 with lower edge 4. Belt hook 38 is shown disposed about the wearer's belt 6. Split ring 37 connects the belt hook 38 to cord lock 47 via aperture 49. Cord lock 47 includes adjuster button 48. The cord 25 passes through cord lock 47 at aperture 46. The cord 25 is attached to the shirt via adhesive page 20 and button hanger 21, as described previously. The cord 25 is affixed to the button hanger via a loop 45 created by doubling the cord 25 upon itself as shown at 43 and held fast by fastener 42. Here, the cord 25 makes only a single pass through the cord lock 47.

Figure 5:
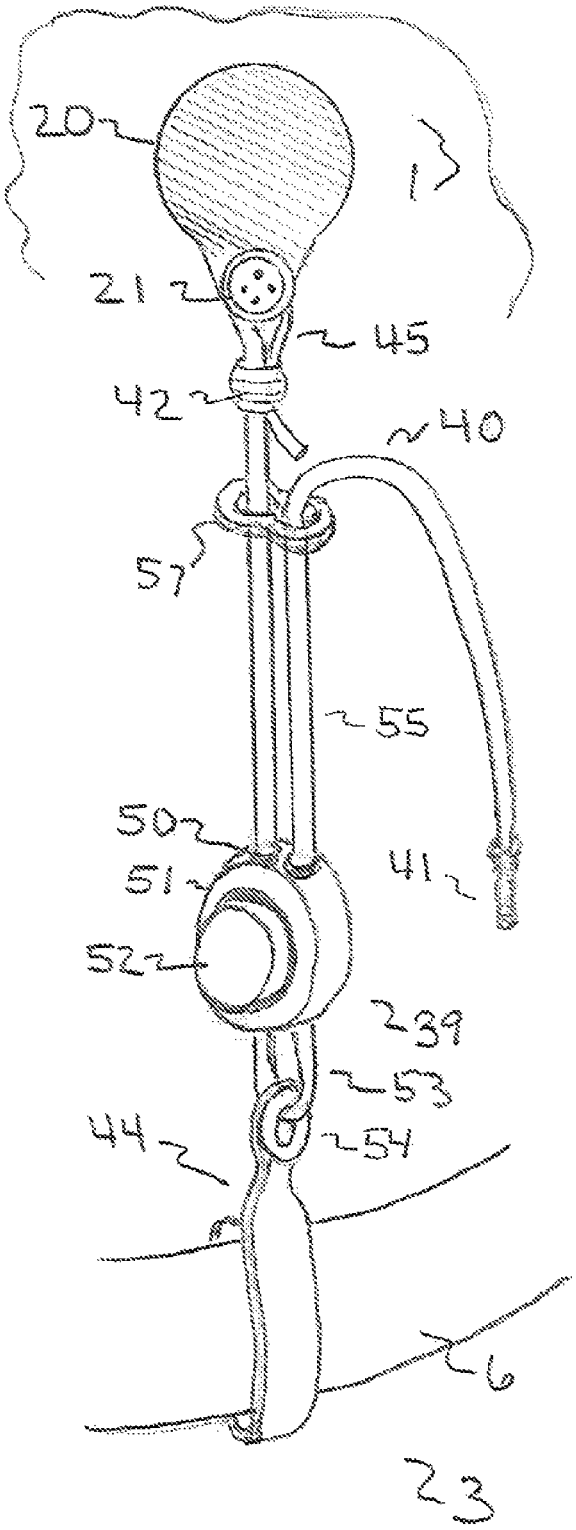
FIG. 5 is a magnified, cutaway view of the shirt hold-down device attached to the inside of the shirt in its extended and connected position between the wearer's shirt and the wearer's pants belt.

FIG. 5 shows yet another version of the device. The version does away with the split ring 37. Rather, the cord 55 passes through cord lock 39 and then through aperture 54 in belt hook 44. This creates an adjustable loop at 53. The housing 51 of the cord lock 39 has two apertures, shown at 50. As shown, the cord 55 passes downward through the cord lock 39 in the left-hand aperture, passes through aperture 54 of the belt hook, heads up through the cord lock 39, and exits the cord lock at the right-hand aperture. An optional keeper 57 is provided to keep the distal end 40 of the cord 55 from dangling. A nib 41 is provided at the far end of the cord 55 to prevent the cord 55 from unthreading through the keeper 57. As in prior version, an adjuster button 55 is provided, which is dimensioned and configured to release the cord 55 when pressed and to firmly grasp the cord 55 when released.

Figure 6:
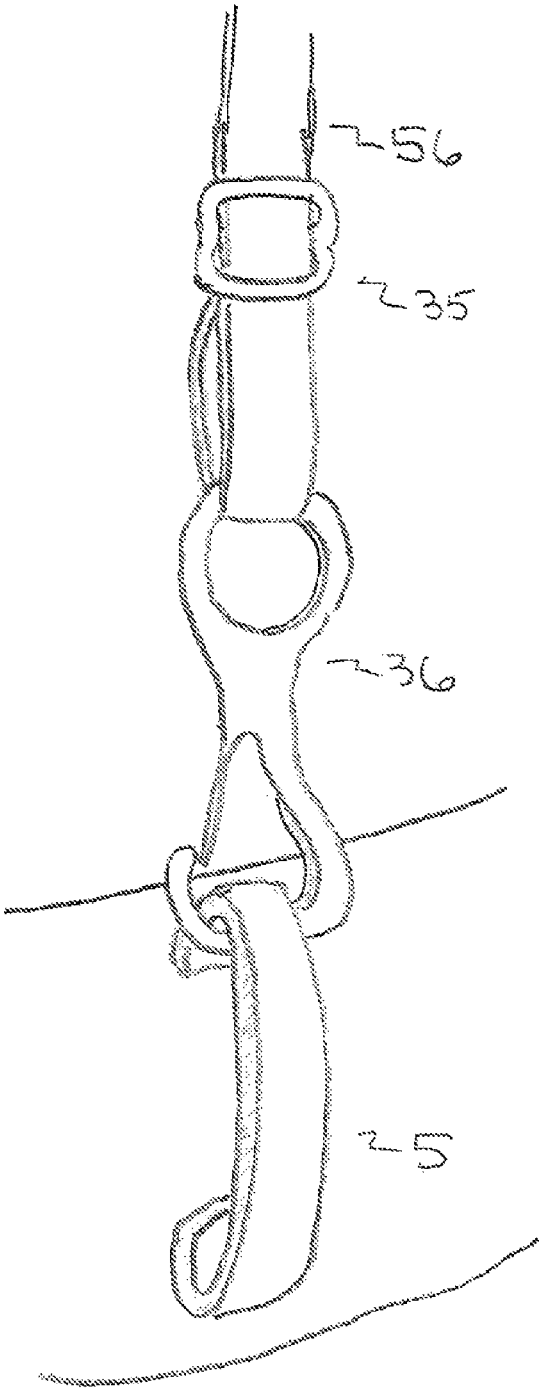
FIG. 6 is an enlarged view of the shirt hold-down device showing the attachment (a snap hook) for the lower end of the shirt hold-down device to a pants belt loop.
Figure 7:
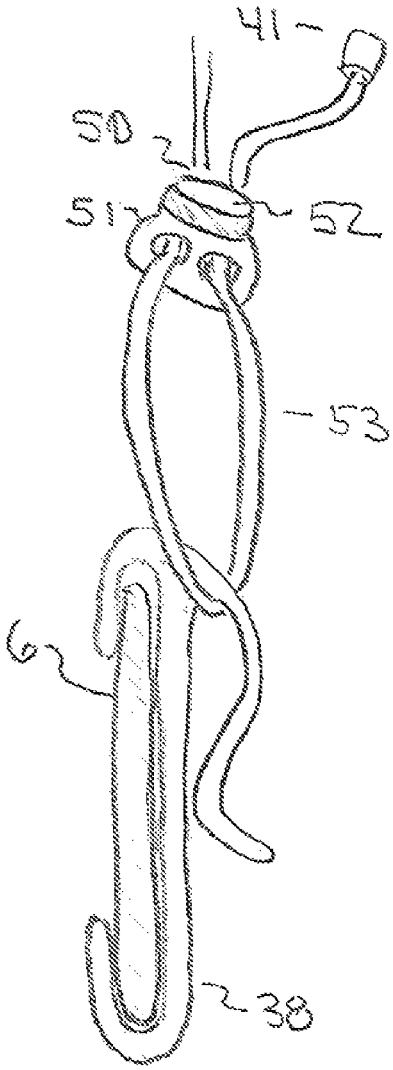
FIG. 7 is an enlarged cross-sectional view of the lower portion of the shirt hold-down device connected to a belt clip (38) connected to a belt (6).

FIGS. 6 and 7 depicted alternative versions in the distal end of the device is attached either to a belt loop 5, via snap hook 36 as shown in FIG. 6, or to the wearer's belt 6 via belt hook 38 as shown in FIG. 7. As shown in FIG. 6, a strap 56 is provided with an adjustable slider 35. In this fashion, the length of the strap between the snap hook 36 and the button hanger (not shown in the figure) can be adjusted. The reference numbering in FIG. 7 is the same as for FIG. 5. See the immediately preceding paragraph.

Figure 8:
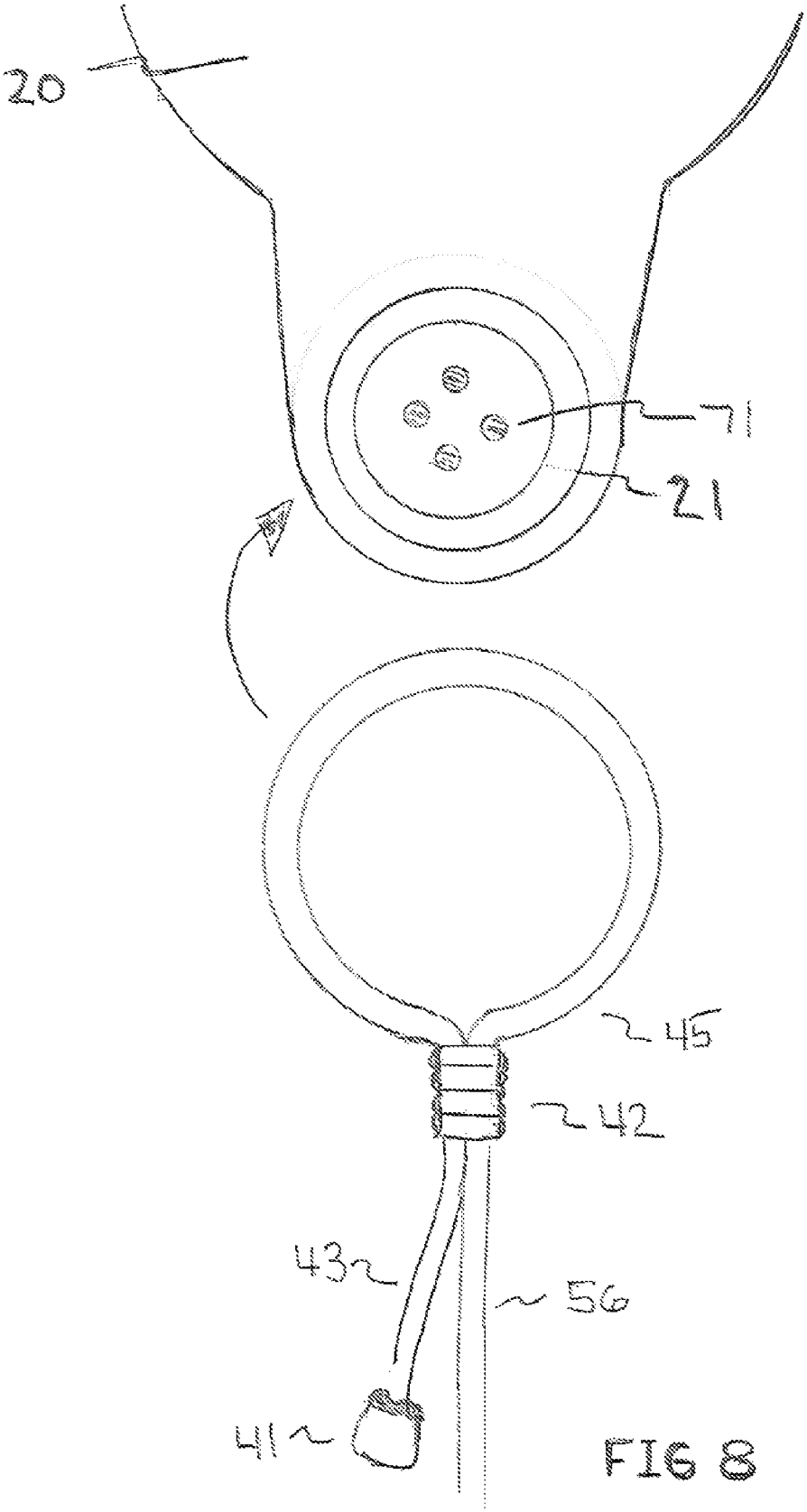
FIG. 8 is a front elevation view of the portion of the shirt hold-down device depicting a portion of the heat-activated adhesive patch (20) with button hanger (45) and elongated cord member (56).

FIG. 8 is a magnified view of the heat-activated adhesive patch 20 with button hanger 21 having apertures 71 for mounting the button hanger to the adhesive patch. Cord 56 is releasably attached to the button hanger 21 via a loop 45 created by doubling the cord 56 upon itself and held fast by fastener 42. The distal end 43 of the cord 56 and nib 41 are also shown.

Figures 9, 10, 11, 12, 13:
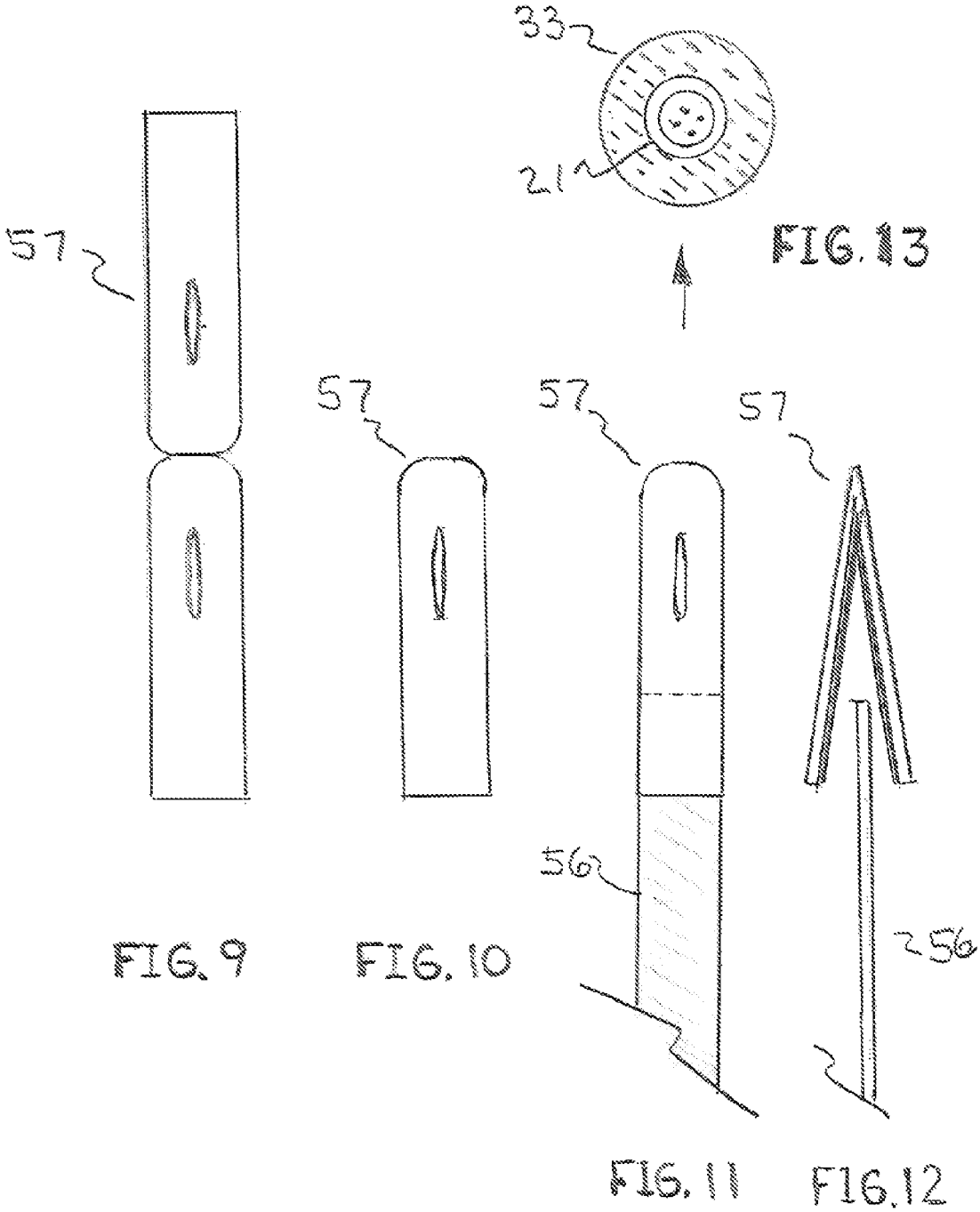
FIG. 9 is frontal view of a heat-activated adhesive patch that has two buttonholes.
FIG. 10 is a frontal view showing the heat-activated patch of FIG. 9 folded in half.
FIG. 11 is a frontal view of the heat-activated adhesive patch shown in FIG. 10 with an end portion of an elongated strap member sandwiched between the heat-activated adhesive patch member with adhesive contacting both sides of the elongated strap member.
FIG. 12 is a side view of the heat-activated adhesive patch shown in FIG. 11 before heat sealing the elongated strap member to the patch.
FIG. 13 is a frontal view of heat-activated adhesive patch (33) with button hanger (21); the arrow shows where the heat-activated adhesive patch with button slot (57; depicted in FIG. 11) is attached to button hanger 21.

FIGS. 9-13 depict another version of the invention in which a ribbon connector 57 is used to create an attachment point/button hole at the upper end of strap 56. FIG. 9 is a frontal view of a heat-activated adhesive patch 57 that has two buttonholes/apertures (unnumbered). The patch 57 is folded upon itself (as shown in FIG. 10) with the strap 56 pinched between the two halves of the patch 57 (as shown in FIGS. 11 and 12). Heat is then applied to the adhesive patch 57 to adhere it to the strap 56. In this fashion, a buttonhole is created at the end of the strap 56. See FIGS. 11 and 12. FIG. 13 depicts the adhesive patch 33 and its associated button hanger 21, which are affixed to the inside of the shirt. The strap 56 is then releasably attached to the button hanger 21 view the unnumbered buttonhole shown in FIG. 11 (see arrow).

Figure 14:
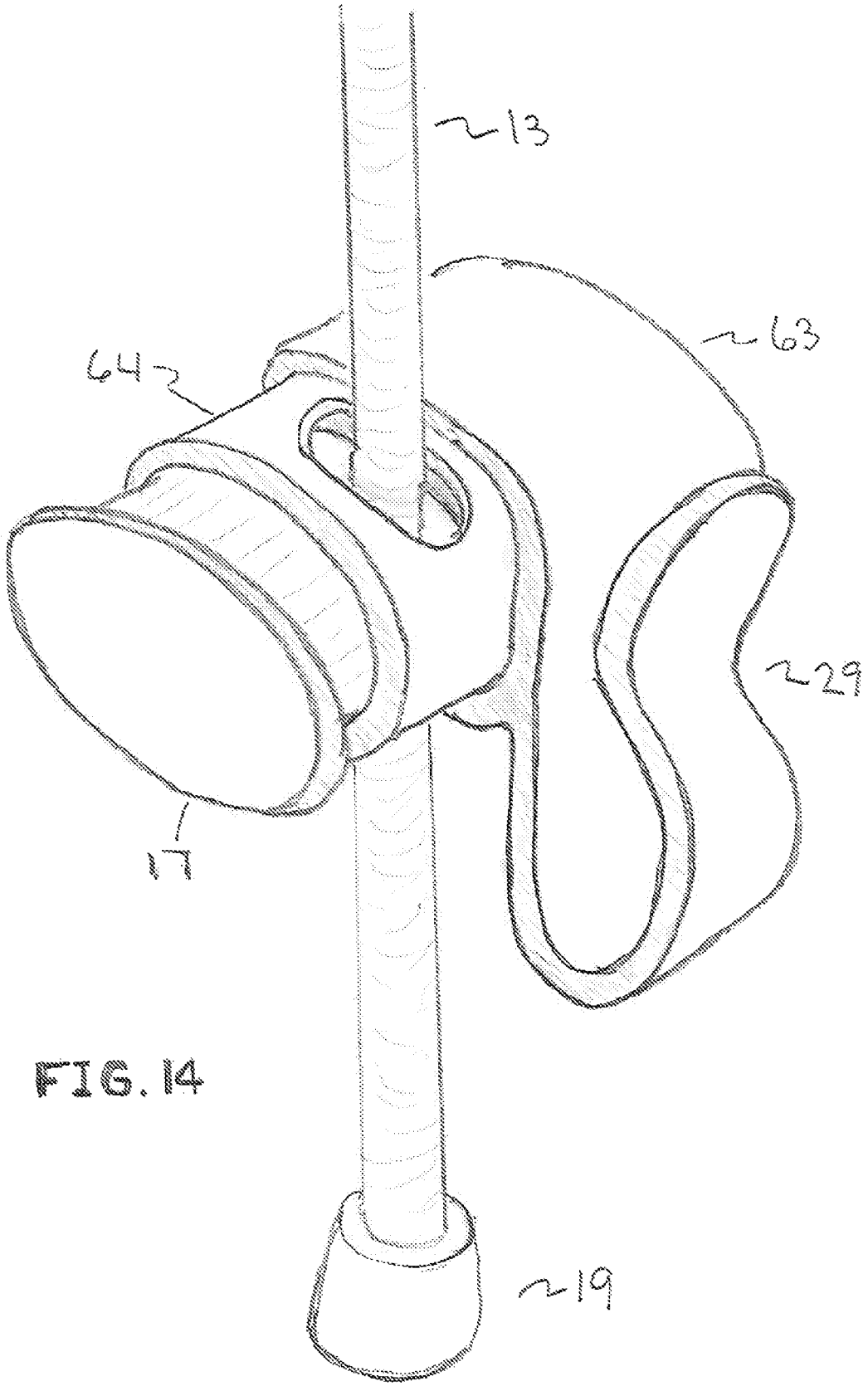
FIG. 14 three-dimensional view showing a part of a shirt hold-down device which is an adjustable cord/strap lock (64) attached to a pants belt clip (29).

FIG. 14 illustrates in isolation an adjustable cord/strap lock 64 attached to a belt hook 29. As noted previously, the cord 13 passes through an aperture in the strap lock 64 that is created when release button 17 is depressed. The release button 17 is biased by a spring (not seen in the figure) toward the closed, clamped position. Thus, when the button is released, the strap lock 64 grips the cord 13 tightly. The strap lock 64 is associated with the the body portion 63 of the belt hook 29. A pull 19 is provided to make adjusting the position of the cord 13 easier and to prevent the cord from becoming unthreaded from the strap lock 64. As shown in FIG. 14, the cord 13 has a roughly circular cross-section.

Figure 15:
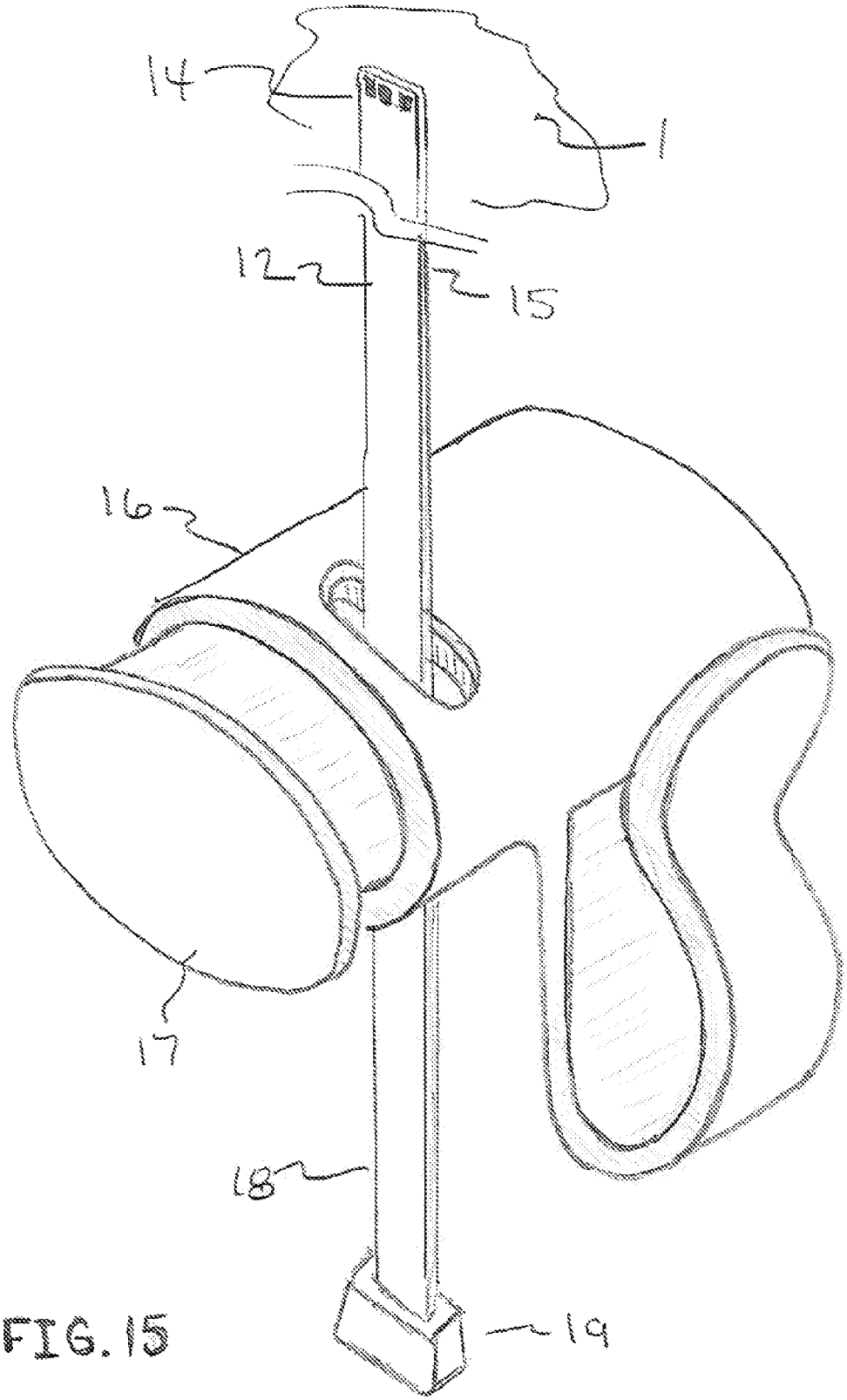
FIG. 15 three-dimensional view showing a part of a shirt hold-down device which is an integral, injection-molded adjustable cord/strap lock and pants belt clip.

FIG. 15 is analogous to FIG. 14, but the strap 12 is flat and rectangular in cross-section-more akin to a ribbon. The strap lock 16 is the same as described for FIG. 14, but dimensioned and configured to clamp the flattened form of the strap 12. Here, the belt hook is not attached to the strap lock 16, but rather is an integral part of the strap lock. Release button 17 is dimensioned and configured as described earlier and functions in the same fashion, The distal end 18 of the strap 12 terminates in a pull 19 as described previously.

Figure 16:
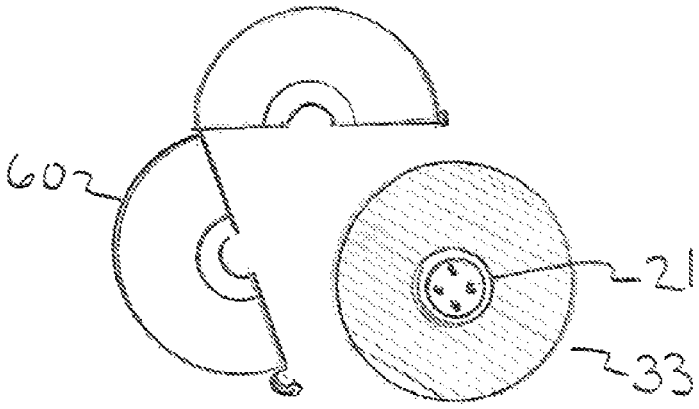
FIG. 16 is a frontal view of a heat-activated adhesive patch with integral button hanger with injection molded plastic spacer for the consumer to use when ironing on the button patch.
Figure 17:
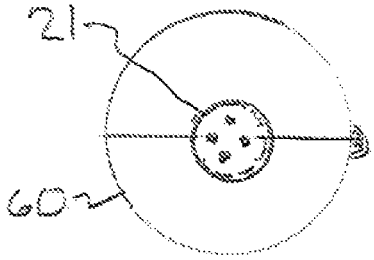
FIG. 17 is a frontal view of the injection molded plastic disposable spacer shown in FIG. 16 entrapping the button patch so a consumer can evenly apply heat and pressure to the patch and the shirt during installation of the patch.
Figure 18:
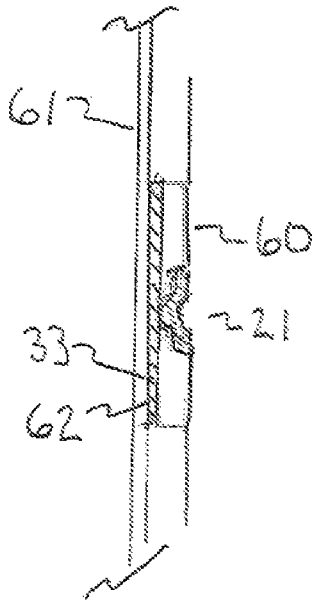
FIG. 18 is a side view showing the disposable plastic spacer entrapping the heat-activated adhesive button patch against the shirt fabric and ready for attachment (via hot-melt adhesive).

FIG. 16, FIG. 17, and FIG. 18 illustrate the construction of the heat-activated adhesive patch with integral button hanger. Also included is an optional spacer 60 for a consumer to use when ironing on the button patch. The spacer 60 ensures that the button hanger 21 is not accidentally adhered to the shirt when the user applies heat to the adhesive patch (using a clothing iron). In FIG. 16, the adhesive patch is shown at 33, along with its associated button hanger 21. To ensure that the button hanger does not accidentally get adhered to the shirt itself, a spacer 60 is provided. The spacer is dimensioned and configured to cover the adhesive patch 33, and to be interposed between the patch 33 and the button hanger 21. As illustrated in FIG. 16, the spacer is shown in two halves, connected by a living hinge. Referring now to FIGS. 17 and 18, the spacer is closed around the adhesive patch 33, leaving the back side of the patch (62; see FIG. 18) uncovered to contact the shirt 61 to which the patch will be adhered. FIG. 18 illustrates in cross-section that spacer 60 encircling the heat-activated adhesive button patch 33 against the shirt 61. The back surface 62 of the patch 33 will then be activated by heat and adhere to the shirt 61. The button hanger 21 is prevented from adhering to the adhesive via the spacer 60. Once the adhesive has cooled and set, the spacer 60 is removed and discarded. The button hanger 21 is then accessible to be attached to the cord or strap as described hereinabove.

Figure 19:
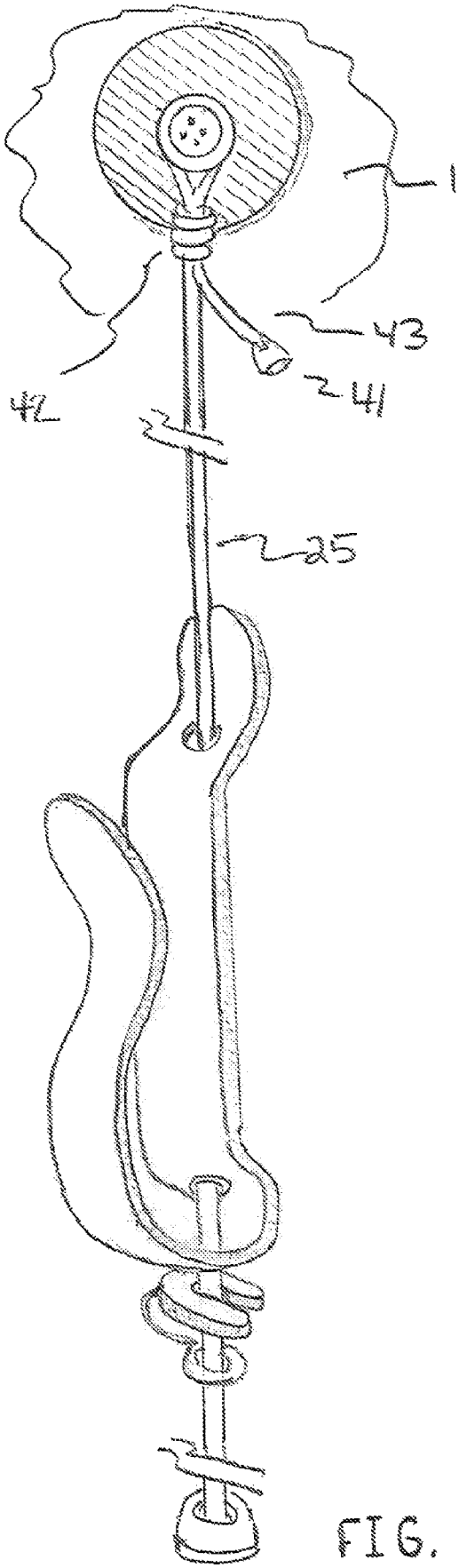
FIG. 19 is three-dimensional view showing the heat-activated patch with button hanger (1) wherein a elastic elongated cord (25) is hung from the hanger and wherein the cord is positioned through two holes in a belt attachment hook with a cord lock below the hook and with a cord pull at the end of the cord.

FIG. 19 shows another version of the device in which the belt hook 38 is configured with an upper aperture 70 and a lower aperture 74 through which passes the cord or strap 25. At the distal end of the cord 25 is an optional stop 74 which is dimensioned and configured to releasably slide along the cord 25. By positioning the stop 25 accordingly, the distance between the crimp cord lock 42 and the belt hook 38 can be adjusted (thereby adjusting the tension placed on the shirt 1). An optional pull 19 is provided at the lower end of the cord 25. An optional nib 41 is provided at the upper end of the cord 25.

Figure 20:
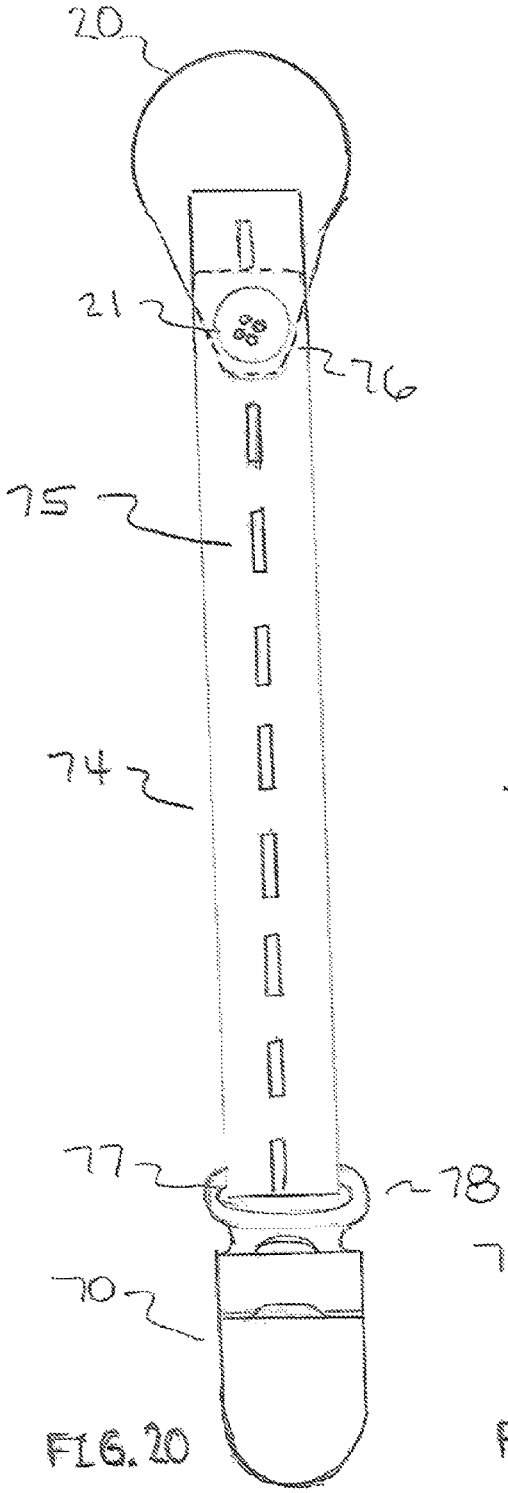
FIG. 20 is a front elevation view of a shirt hold-down device comprising a heat-activated adhesive patch with a sewn-on button attached to an elongated strap member that has a series of buttonholes and is connected to reversible fastener (here, an alligator clip).
Figure 21:
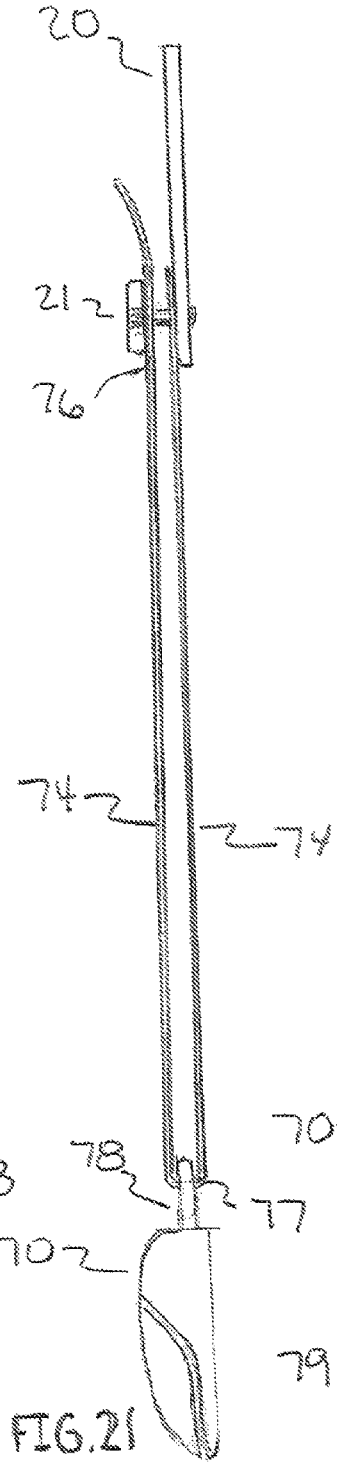
FIG. 21 is a side elevation of a shirt hold-down device showing the heat-activated adhesive patch with sewn-on button to the patch and where the elongated strap with a series of buttonholes is attached to the fastener and returns to be attached to the button.
Figure 22:
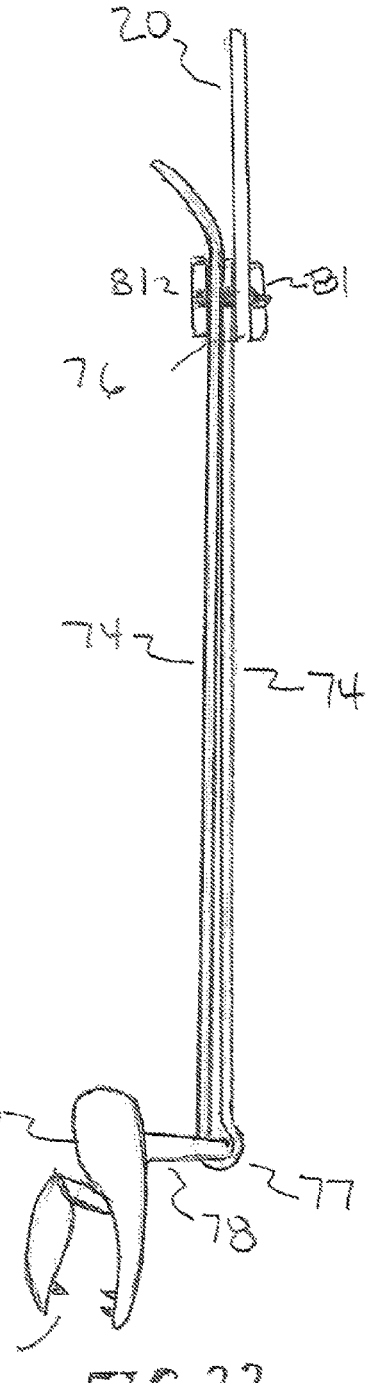
FIG. 22 is a side elevation of another preferred embodiment of the shirt hold-down device where the heat-activated patch has a button slot or slit where a the plastic molded component consists of two integrally molded button sharing the same core or shaft which is positioned through the slot in the the patch and through the slot in the elongated strap with a series of buttonholes and where the strap goes through the opening in the plastic alligator clip, shown here in the open position and the elongated strap returns to and is hooked on the two-sided button.

FIGS. 20, 21, and 22 show yet another version of the hold-down device. FIG. 20 is a front elevation view; FIG. 21 is a side elevation view with the alligator clip 70 closed; FIG. 22 is a side elevation view of the alligator clip 70 open. Shown in FIG. 20 is a heat-activated patch 20 having a button 21 attached thereto. The heat-activated path is permanently affixed to the inside surface 1 of a shirt. See also FIG. 19. Referring to all three of FIGS. 20, 21, and 22, an adhesive patch 20 is provided with its associated button hanger 21 as described previously. A strap 74 is provided with a plurality of buttonholes (or other suitably shaped apertures) passing therethrough. An alligator clip 70 is provided. The alligator clip includes an actuator 78 that opens and closes the jaws of the alligator clip. FIG. 21 shows the alligator clip in the closed position when the actuator 78 is vertically oriented. FIG. 22 shows the alligator clip in the open position when the actuator 78 is horizontally oriented. The actuator 78 includes an aperture 77 passing therethrough. The aperture 77 is dimensioned and configured to allow the strap 74 to pass therethrough. As shown in FIG. 21, the alligator clip is biased toward the closed position when vertical tension is placed on the actuator 78. In this fashion, when the strap 74 is pulled vertically away from the alligator clip 70, the grasping force of the jaw 79 of the alligator clip 70 increases. The alligator clip, of course, may be attached to the wearer's pants, belt loops, belt, or pants pocket, thereby holding the wearer's shirt in place.

As shown in FIGS. 20, 21, and 22, the strap 74 is passed through aperture 77, folded back on itself, and connected to button hanger 21 via one of the buttonholes 75 in the strap 74. As shown in these three figures, strap 74 is attached to button hanger via button hanger 76.

What is claimed is:

1. A shirt comprising:

a shirt hold-down device permanently or releasably attached thereto, the shirt hold-down device comprising:

a tether having a first end and a second end; and first and second fasteners attached to the tether at a distance apart, wherein the first fastener is attached proximate to the first end of the tether and the second fastener is attached proximate to the second end of the tether;

wherein the first fastener is dimensioned and configured to attach to an inside surface of the shirt permanently or releasably; and wherein the second fastener is dimensioned and configured to attach to a wearer's pants or a wearer's belt releasably; and wherein the first fastener or the second fastener or both the first and second fasteners are movably attached to the tether such that the distance between the first and second fasteners along the tether can be varied; and wherein the first fastener comprises a heat-activated patch having a button attached thereto permanently affixed to the inside surface of the shirt and a corresponding loop or aperture defined in the first end of the tether and dimensioned and configured to releasably attach to the button.

2. The shirt of claim 1, wherein the shirt is a t-shirt, a pull-over partial button-down shirt, a collared shirt, a collarless shirt, a full button-up shirt, a full button-down shirt, or a long or short sleeve shirt.

3. The shirt of claim 1, wherein the tether comprises a cord having a substantially circular cross-section.

4. The shirt of claim 1, wherein the tether comprises a ribbon having a substantially rectangular cross-section.

5. The shirt of claim 1, wherein the aperture defined in the first end of the tether is defined by a length of material having juxtaposed first and a second button holes defined therein, and coated on one side with a permanent adhesive, wherein the length of material is folded upon itself with the first end of the tether interposed therebetween such that the first and second button holes are in registration and the permanent adhesive contacts the first end of the tether such that the length of material is permanently adhered to the tether.

6. The shirt of claim 1, wherein the second fastener is an alligator clip.

7. The shirt of claim 1, wherein the second fastener is a hook dimensioned and configured to releasably attach to a belt and having two apertures passing therethrough, wherein the tether passes through the two apertures, and further comprising a stop slidably attached proximate to the second end of the tether and dimensioned and configured to prevent the tether from being withdrawn from the two apertures in the hook.

8. The shirt of claim 1, wherein the second fastener is spring-biased cord lock slidably disposed around the tether and having defined therein a hook dimensioned and configured to releasable attach to a belt or belt loop of a wearer.

9. A shirt comprising:

a shirt hold-down device permanently attached thereto, the shirt hold-down device comprising:

a tether having a first end and a second end; and first and second fasteners attached to the tether at a distance apart, wherein the first fastener is attached proximate to the first end of the tether and the second fastener is attached proximate to the second end of the tether;

wherein the first fastener is permanently attached to an inside surface of the shirt; and wherein the second fastener is dimensioned and configured to attach to a wearer's pants or a wearer's belt releasably; and wherein the second fastener is movably attached to the tether such that the distance between the first and second fasteners along the tether can be varied; and wherein the second fastener is a hook dimensioned and configured to releasably attach to a belt and having two apertures passing therethrough, wherein the tether passes through the two apertures, and further comprising a stop slidably attached proximate to the second end of the tether and dimensioned and configured to prevent the tether from being withdrawn from the two apertures in the hook.

10. The shirt of claim 9, wherein the second fastener is an alligator clip.

11. The shirt of claim 9, wherein the second fastener is spring-biased cord lock slidably disposed around the tether and having defined therein a hook configured to releasable attach to a belt or belt loop of a wearer.

12. A shirt hold-down device, the shirt hold-down device comprising:

a tether having a first end and a second end; and first and second fasteners attached to the tether at a distance apart, wherein the first fastener is attached proximate to the first end of the tether and the second fastener is attached proximate to the second end of the tether;

wherein the first fastener is dimensioned and configured to attach to an inside surface of the shirt permanently or releasably;

wherein the second fastener is dimensioned and configured to attach to a wearer's pants or a wearer's belt releasably;

wherein the first fastener or the second fastener or both the first and second fasteners are movably attached to the tether such that the distance between the first and second fasteners along the tether can be varied; and wherein the second fastener is a hook dimensioned and configured to releasably attach to a belt and having two apertures passing therethrough, wherein the tether passes through the two apertures, and further comprising a stop slidably attached proximate to the second end of the tether and dimensioned and configured to prevent the tether from being withdrawn from the two apertures in the hook.

13. The shirt hold-down device of claim 12, wherein the second fastener is an alligator clip.

14. The shirt hold-down device of claim 12, wherein the second fastener is spring-biased cord lock slidably disposed around the tether and having defined therein a hook configured to releasable attach to a belt or belt loop of a wearer.

15. The shirt hold-down device of claim 12, wherein the first fastener comprises a heat-activated patch having a button adhered to it and the tether defines a corresponding aperture proximate the first end, the aperture dimensioned and configured to releasably attach to the button.

16. The shirt hold-down device of claim 15, further comprising, in combination, a heat-resistant, removable spacer interposed between the heat-activated patch and the button.

* * * * *